United States Patent [19]

Appelt et al.

[11] Patent Number: 4,484,379

[45] Date of Patent: Nov. 27, 1984

[54] CLAMPING BUCKLE

[75] Inventors: Horst G. Appelt; Günter Wolfertz, both of Wuppertal, Fed. Rep. of Germany

[73] Assignee: Schaeffer-Scovill Verbindungstechnik GmbH, Wuppertal, Fed. Rep. of Germany

[21] Appl. No.: 439,469

[22] Filed: Nov. 5, 1982

[30] Foreign Application Priority Data

Nov. 14, 1981 [DE] Fed. Rep. of Germany ..... 3145360

[51] Int. Cl.[3] ..... A44B 11/00

[52] U.S. Cl. ..... 24/197; 24/17 B; 24/198; 24/170; 24/200

[58] Field of Search ..... 24/197, 198, 199, 200, 24/17 B, 176, 169, 68 CD, 68 F, 166, 170

[56] References Cited

U.S. PATENT DOCUMENTS

| | | | |
|---|---|---|---|
| 718,710 | 1/1903 | Houghton | 24/166 |
| 2,020,531 | 11/1935 | White . | |
| 2,388,316 | 11/1945 | Elwell | 24/170 |
| 3,251,108 | 5/1966 | Harrison | 24/166 |
| 3,336,639 | 8/1967 | Rutty et al. | 24/200 |
| 3,813,734 | 6/1974 | Schauweker et al. | 24/200 |
| 3,967,347 | 7/1976 | Bickis, Sr. . | |
| 3,969,792 | 7/1976 | Hattori | 24/200 |
| 3,978,555 | 9/1976 | Weisenthal . | |
| 4,038,726 | 8/1977 | Takabayashi | 24/198 |
| 4,299,014 | 11/1981 | Wood | 24/197 |
| 4,387,490 | 6/1983 | Blackburn et al. | 24/200 |
| 4,400,855 | 8/1983 | Stuart | 24/200 |

FOREIGN PATENT DOCUMENTS

| | | | |
|---|---|---|---|
| 2612030 | 1/1977 | Fed. Rep. of Germany . | |
| 1225806 | 7/1960 | France | 24/169 |
| 2192781 | 2/1974 | France . | |
| 2202661 | 5/1974 | France . | |
| 23099 | 3/1901 | Switzerland | 24/197 |

*Primary Examiner*—Victor N. Sakran

*Attorney, Agent, or Firm*—Martin A. Farber

[57] ABSTRACT

A clamping buckle for straps, particularly shoulder straps on articles of clothing, with two buckle sections which are swingable with respect to each other around a transverse buckle axis, the buckle sections having a clamping position for clamping the strap. The buckle sections lie one on top of the other approximately parallel to each other with the formation of a gap therebetween. The buckle sections have respective gap sides which face the gap and respective outsides which face away from the gap, and they have slots and bars for diverting the straps including a bar in one buckle section opposite a slot in the other buckle section. The bar of the first buckle section is aligned on its gap side with a plane of the first buckle section and is of at least the same width as the slot of the other buckle section. A loop of the strap wraps around the bar and includes loop end portions passing through the slot that extend by the outside of the second buckle section.

6 Claims, 6 Drawing Figures

CLAMPING BUCKLE

The present invention relates to a clamping buckle for straps, particularly shoulder straps on articles of clothing, consisting of two buckle sections which are swingable with respect to each other around a buckle cross axis. The buckle sections, in the position in which they clamp the straps, lie one on top of the other approximately parallel to each other with a gap formed therebetween. The buckle sections have slots and bars for diverting the straps in a manner whereby a bar of one buckle section is opposite a slot in the other buckle section.

A clamping buckle of this kind is known from West German Utility Model No. 80 29 341. The shoulder strap passes through a slot in the buckle cross axis which is developed as a film hinge. The section of the strap extending within the gap is gripped by the protruding bar when the sections of the buckle are folded against each other and the strap is pressed into a slot in the other section of the buckle. In this way an engagement is obtained whereby the region of the strap which is placed around the bar and practically converted into a narrow loop shape is clamped against the slot surfaces, with compression of the strap material. This development is disadvantageous inasmuch as the engagement is obtained only as a function of the proper thickness of the material. Furthermore, a certain roughness of the surface must be present. Thus, for instance, in the case of smooth straps which are under tension, slippage cannot be avoided. A further undesirable situation is that pulls on the strap act upon the clamping buckle in the direction towards the opening thereof. Thus in case of weak clamping forces there is definitely the danger that the section of strap which has been brought into a loop shape but extends under tension will lift the bar extending over the gap out of the slot.

The object of the present invention is to develop a clamping buckle of the above-mentioned type in a manner which is dependable in use and simple to manufacture so that, despite deflection of the section of the strap which can be brought into clamped, fixed position, pulling forces on the shoulder strap can no longer be converted into a force which results in the opening of the buckle.

This purpose is achieved in the manner that the bar (4) which is aligned on the gap side with the plane of the buckle section (E—E) is of the same width as or wider than the facing slot (6) through which the two ends of a loop (Sch) of the strap (G) which completely wraps around the bar (4) are threaded up to the outside of the buckle.

As a result of this development a clamping buckle of the above-indicated type which is of particularly high value in use is furnished. In particular, reliability of closing is optimalized. The slip-free association of the strap is no longer dependent on the use of a given thickness of material of the strap or the nature of its surface. The clamping action is extremely gentle for the material. For this purpose the bar which is aligned on the gap side with the plane of the buckle section is in simple manner made wider than the slot lying opposite it through which the two ends of a loop of the strap which completely surrounds the bar are passed to the outside of the buckle. This clamping loop is self-locking. A tensile stresses which act on the strap do not operate to spread apart the two buckle sections which are hinged to each other but advantageously press the buckle sections against each other. Independently of this it is also advantageous to secure the clamping buckle in the functional position. This is true, in particular, in cases in which the clamping buckle is produced as a single-piece injection molding in which the buckle sections are connected via a film hinge which is formed thereon. Since the entire body is injected preferably in the stretched position it is possible, depending on the thickness of the film hinge, for greater or lesser restoring forces to occur. For this reason the buckle cross section which has the bar is provided on the gap side with a detent which snaps into an opposing detent on the other section of the buckle. It is advantageous from a structural standpoint with regard to the development of the detent means if the detent is seated on the free transverse end edge of one of the sections of buckle and is developed as a finger which bridges over the gap which snaps behind a clip edge, developed with opposing drop bevels, of the other section of the buckle. For convenient opening of the buckle the detent head of the finger in one embodiment also has two oppositely directed drop bevels.

With the above and other objects and advantages in view, the present invention will become more clearly understood in connection with the detailed description of a preferred embodiment, when considered with the accompanying drawings, of which:

The clamping buckle shown consists of two clamp sections I and II which are swingable towards each other around a clamp across axis x—x.

Figure 2:
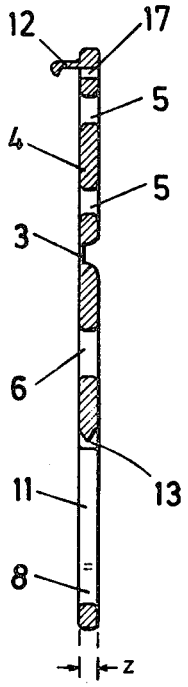
FIG. 2 is a section along the line II—II of FIG. 1.
Figure 4:
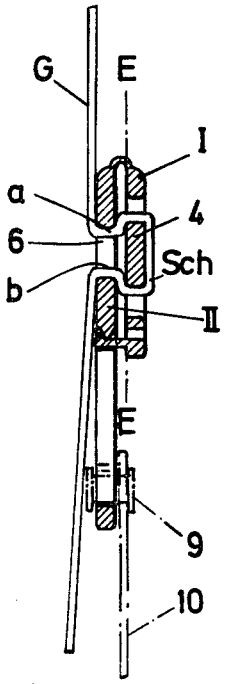
FIG. 4 is a section along the line IV—IV of FIG. 5 with tab.
Figure 6:
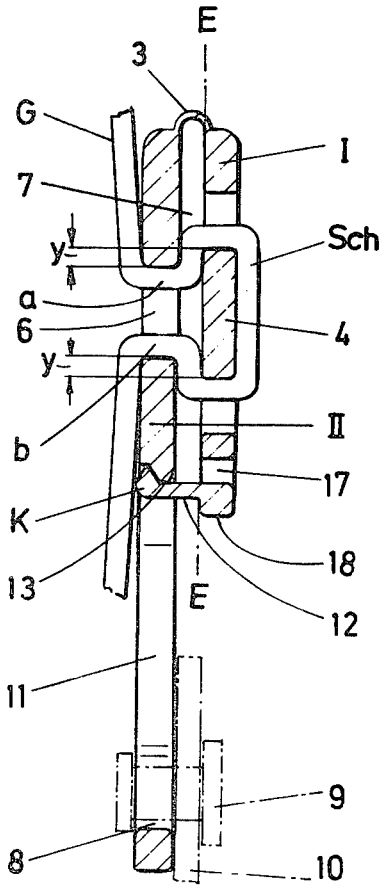

The entire buckle body consists of a single part made by injection molding forming, within the region of the transverse axis, a film hinge 3 obtained by reduction in cross section of the material. The injection molding is effected in a mold which corresponds to the unfolded position of the buckle body (see FIGS. 1 and 2). The film hinge 3 is at an edge of the buckle sections I, II when they are folded against each other as shown in FIGS. 4 and 6.

The buckle section 1 is developed such that its central zone forms a bar 4 extending parallel to the transverse axis x—x of the buckle. The bar 4 is flanked on both sides by a slot 5. The two slots 5 are of the same length. Their width is in accordance with that of ordinary strap thicknesses.

Figure 3:
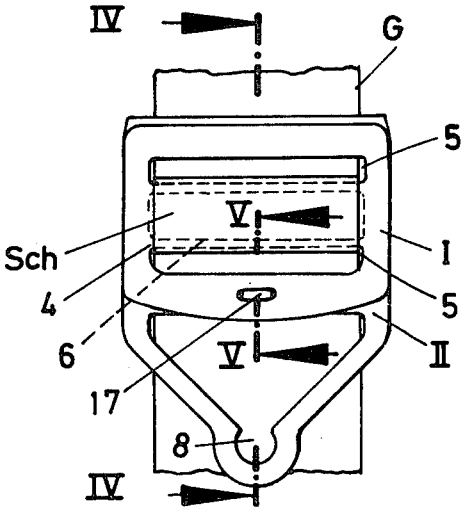
FIG. 3 shows the buckle brought into the basic position ready for use with the shoulder strap inserted, without tab.
Figure 5:
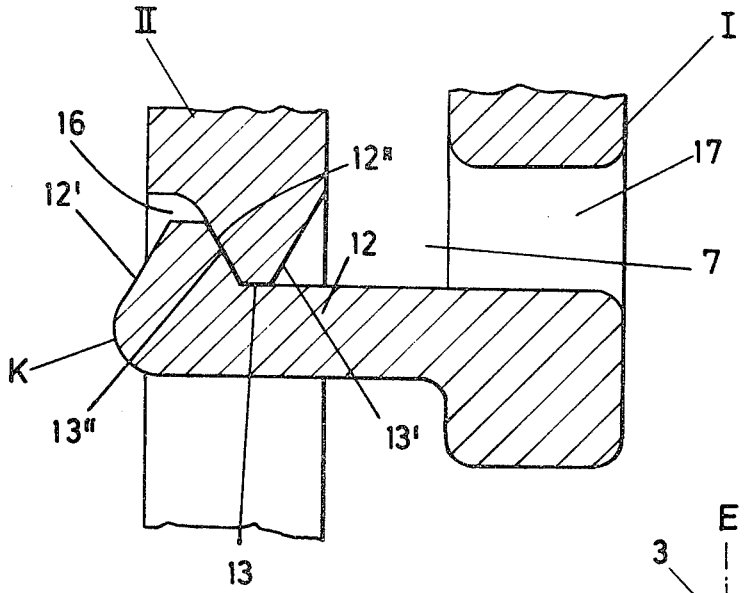
FIG. 5 is a section along the line V—V of FIG. 3 on a considerably larger scale than in FIG. 3; and, FIG. 6 is a section in accordance with FIG. 4 on a larger scale.

The position of the bar 4 is so selected that when the clamping buckle is brought into a book-cover-like folded position as shown in FIG. 3, the bar 4 is opposite a slot 6 of the other buckle section 11. The width of this slot 6 corresponds to twice the width of one of the slots 5. The gap between the two buckle sections I and II swung against each other is designated 7. The bar 4 which is aligned with the buckle section plane E—E on the gap side is wider than the width of the opposite slot 6 in the other buckle section II. With the symmetrical superpositioning of the bar 4 over the slot 6 as shown in FIGS. 4 and 6, there is thus produced an overlap zone y on both sides of both longitudinal edges of the bar 4 and slot 6. The overlap zones 5 operate as clamping surfaces and correspond for example to about half the thickness z of the plate of the buckle body.

The longitudinal edges of bar 4 and slot 6 which extend outwards and on the gap side are left square or at most slightly beveled.

The associating of the strap G is effected in such a manner that is comes from above as a shoulder strap. It is introduced from the rear of the buckle, i.e. from the buckle section II through the slot 6 thereof. From there the strap G takes an upwardly directed path within the gap 7 in order to emerge through the upper slot 5 of the buckle section I on the front side of the clamping buckle. Continuing then the shoulder strap G wraps completely around the bar 4, for which purpose it is again introduced through the lower slot 5 of the buckle section I. The strap G again passes upwardly through a section formed by the gap 7 and then emerges again through the slot 6 of the buckle section II. The free end of the buckle strap G points downwardly in the plane of the feed. The loop which closely wraps the bar 4 is designated Sch, and the ends which pass jointly through the slot 6 are designated by a and b. Pulls exerted on the shoulder strap G pull the buckle section I which is folded in the manner of a book cover more firmly against the gap-side surface of the other buckle section II, reducing the size of the gap 7. The overlap zones y act in this connection as clamping surfaces.

Figure 1:
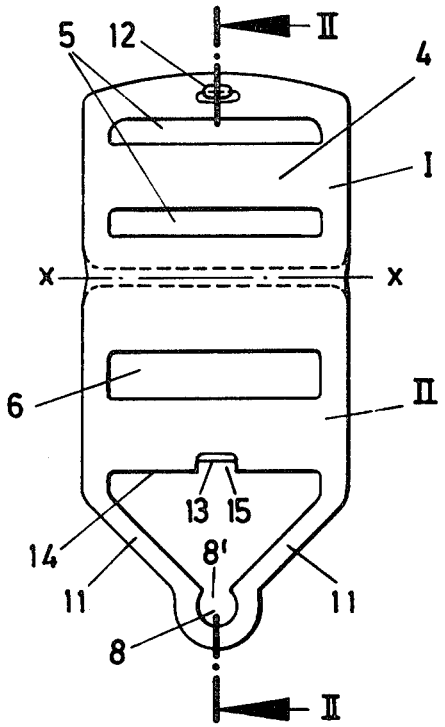
FIG. 1 is a front view of a clamping buckle incorporating one embodiment of the invention with the clamping sections thereof in a stretched position.

As can be seen most clearly in FIGS. 1 and 6, the buckle section II continues downward into an eye 8 for the insertion of a button 9 of a tab 10 which extends, for instance, from the flap (not further shown) of an article of clothing and can be conveniently inserted and removed. A funnel-shaped engagement region formed of arms 11 of the buckle section II is placed in front of the eye opening 8' of reduced cross section. The button 9 is of such a nature that button plates extend on both sides of the eye 8 and the button arm joining the button plates lies within the cavity of the eye.

In order to prevent a divergence of the buckle body which consists, of the folded sections I and II, a detent extends from the buckle section I which forms the bar 4, the detent snapping into a mating detent on the other buckle section II. The detent is developed as a finger 12 which bridges the gap 7 and extends from a free front edge 18 of the buckle, i.e. the buckle section I. The finger 12 can easily be simultaneously produced during the injection molding of the buckle. The finger 12 snaps behind a clip edge 13 of the other buckle section II. The clip edge 13 lies in a niche 15 which is recessed as compared with the transverse front edge 14 present there. The clip edge 13 has oppositely directed drop bevels 13', 13'' which drop off in gable-shape with equal angles as seen in the direction of the longitudinal section shown in the drawing.

Furthermore, the end section of the finger 12 which forms a detent head K of the finger 12 also is provided with oppositely directed drop bevels 12', 12''.

In establishing a snap connection, the drop bevel 12'' which drops down in the direction towards the gap 7 slides over the drop bevel 13' of the clip edge 13 which assumes a corresponding inclined course. The finger 12 moves aside, travels over the clip edge 13 and then moves over the outward pointing drop bevel 13''. The corresponding drop bevel 12'' of the detent head K assumes the same course.

The clip edge 13 is shifted slightly in the direction towards the gap 7 from the central plane of the buckle section II so that an immersion space 16 for the detent head K is present on the outside. The detent head K extends only slightly beyond the rear surface of the buckle. The niche 15 is approximately the width of a fingertip so that a user can easily open the snap connection by moving the finger 12 at an angle. The corresponding bevel path makes it also possible to swing the buckle section I up, overcoming the forces of the snap engagement. The corresponding upwardly swung position makes it possible to adjust the individual length of the shoulder strap G since no clamping takes place in this spread position. The opening 17 at the foot of the finger 12 comes from the transverse slide of the mold removal tool.

The film hinge 3 permits elastic adjustment of the gap 7 to different thicknesses of strap.

We claim:

1. In a clamping buckle for a strap having a buckle upper part and a buckle lower part, said upper part and said lower part being swingable with respect to each other around a hinge axis, wherein said upper part and lower part have a position for clamping the strap in which said parts are engaged one above the other in approximately parallel planes and form two pull-through gaps, said parts having slots and arms for diverting the strap including an arm of the buckle upper part opposite and partially overlapping a slot of the buckle lower part forming an angularly bent pull-through gap course, the improvement wherein:

said hinge axis extending transverse to a pull-through direction of the strap;

said buckle upper part having a single central arm and two slots adjoining and defining the latter and defining said two pull-through gaps;

said buckle parts being engageable one above the other in a position determining a maximum inside opening of the pull-through gaps.

2. The clamping buckle according to claim 1, wherein said buckle lower part includes a fastening tab for securing a fixed end of the strap.

3. The clamping buckle according to claim 1, wherein said buckle upper part includes a detent formed on a free transverse front edge thereof on a centrally located finger for bridging the pull-through gaps.

4. The clamping buckle according to claim 3, wherein the buckle lower part includes a clip edge formed with oppositely directed drop bevels and the detent of the finger of the buckle upper part snaps behind said clip edge by moving beyond said clip edge.

5. The clamping buckle according to claim 4, wherein the detent of the finger of the buckle upper part is formed with a detent head having two oppositely directed drop bevels.

6. The clamping buckle according to claim 5, wherein one of the drop bevels of the detent head engages one of the drop bevels of the clip edge when the detent of the finger snaps behind said clip edge.

* * * * *